US010362908B1

(12) United States Patent
Quinn

(10) Patent No.: US 10,362,908 B1
(45) **Date of Patent: *Jul. 30, 2019**

(54) WEIGHTED TOWEL WITH HANDLES

(71) Applicant: Kathleen Quinn, Chesterfield, MO (US)

(72) Inventor: Kathleen Quinn, Chesterfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/586,477

(22) Filed: May 4, 2017

Related U.S. Application Data

(63) Continuation-in-part of application No. 14/196,277, filed on Mar. 4, 2014, now Pat. No. 9,671,165.

(51) Int. Cl.
*A47K 10/02* (2006.01)

(52) U.S. Cl.
CPC ..... *A47K 10/02* (2013.01); *Y10T 428/24008* (2015.01)

(58) Field of Classification Search
CPC .. Y10T 428/24008; A47K 10/02; A47G 9/062
USPC ..... 428/99
See application file for complete search history.

(56) References Cited

U.S. PATENT DOCUMENTS

| | | | | |
|---|---|---|---|---|
| 4,634,618 | A | 1/1987 | Greer | |
| 5,018,229 | A * | 5/1991 | Eberhart | A47G 9/062 428/100 |
| 6,849,055 | B1 | 2/2005 | Williams | |
| 7,955,683 | B1 | 6/2011 | Ferrell | |
| 8,307,476 | B1 | 11/2012 | Weaver | |
| 8,434,191 | B2 | 5/2013 | Shorees | |
| 9,671,165 | B1 * | 6/2017 | Quinn | A47K 10/02 |
| 2006/0174410 | A1 * | 8/2006 | Mastandrea, Jr. | A01K 1/0353 5/482 |
| 2008/0163443 | A1 | 7/2008 | Brown | |
| 2009/0236299 | A1 * | 9/2009 | Hall | A47K 10/02 211/16 |
| 2010/0017960 | A1 * | 1/2010 | Blaauboer | A47G 9/062 5/417 |
| 2013/0014325 | A1 | 1/2013 | Argento | |

* cited by examiner

*Primary Examiner* — Alexander S Thomas
(74) *Attorney, Agent, or Firm* — CreatiVenture Law; Linda L Lewis

(57) ABSTRACT

A weighted towel manufactured from an absorbent material having weights near or at one end which allows a person with limited mobility, dexterity or range of motion to have the ability to dry himself; the weights allow the end to wrap around a body extremity to dry areas of a limb which are difficult to reach or touch, where the weights are heavy material enclosed in a pocket in the towel that allows the weight to conform to the limb, or the foot and toes when pressed against.

16 Claims, 11 Drawing Sheets

WEIGHTED TOWEL WITH HANDLES

CROSS-REFERENCE TO RELATED APPLICATIONS

This application is a continuation-in-part of U.S. Pat. No. 9,671,165, filed Mar. 4, 2014 and issued Jun. 6, 2017, which is hereby incorporated by reference, and which claims priority from U.S. Provisional Patent Application No. 61780215 filed Mar. 13, 2013, which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The art of the present invention relates to towels for drying in general and more particularly to a weighted towel having one or more handles at one end or in the middle portion which allows persons having limited mobility or range of motion to perform a drying motion with a minimum of assistance from others or with no assistance.

Towels utilized for drying are well known in the art. Presently, said towels are typically manufactured from a terrycloth material having a rectangular form or outline which is also absorbent to water and other liquids. U.S. Pat. No. 6,849,055 discloses a towel having ribs for drying the back using opposing handles and the user must use both hands to move the towel up and down along the back to dry it. U.S. Pat. No. 4,634,618 discloses a beach towel that has weights around the towel perimeter to prevent the towel from being blown on the beach. U.S. Pat. No. 7,955,683 discloses a magnetic anchoring towel system having two magnets that allow the towel to encircle and anchor on a handle or device.

The present art provides a towel with weights, and in an alternative embodiment, with handles at one end or position which allows a person having limited mobility or range of motion to effectively dry portions of the body, especially the limb extremities and back. The present art uniquely provides a towel having one or more handles on the top end or the middle portion and a bottom end weighted portion which allows a person to reach and dry his back or his extremities such as legs and arms. The towel does not have opposing handles that require the use of two hands to provide a drying movement, nor does the towel have opposing magnets to encircle a handle or device. The bottom end weighted portion allows positive contact with the person's body with the use of only one hand or both hands positioned together. The bottom end, via the action of gravity, is extended to the lower portion of the back or a limb even though the user cannot reach to the lower portion with his hand.

An embodiment of the present invention has hook and loop fasteners near the bottom end which cause the towel to conform and wrap around the person's limb while performing the drying process when the towel is draped over the leg or other extremity. This embodiment allows the back of the leg or other extremity to be easily dried.

Accordingly, it is an object of the present invention to provide a weighted towel with handles having one or more handles at a top end or central portion and one or more weights at a bottom or top end which allows a person to dry a portion of the body while having limited mobility or reach.

Another object of the present invention is to provide a weighted towel with handles at one position on the towel that allow a person with mobility impairment to have more independence without continually relying on another person for help with drying portions of the body.

A further object of the present invention is to provide a weighted towel with handles having one or more hook and loop fasteners at a bottom end or top end that naturally contact when the towel is placed around the leg or other extremity and allows a person to dry the back portion of said limb.

SUMMARY OF THE INVENTION

In accordance with the present invention, a preferred embodiment represents a weighted towel with a handle comprising a towel, one or more handles at a top end, and one or more weights at a bottom end. Another preferred has weights on the bottom end and one or more handles within the middle portion of the towel, which allows a person more flexibility in drying the extremities. The natural drape formed as a result of the weight allows the towel to wrap around the extremity. When the towel is held by the handle in the central portion, the unweighted top of the towel acts as a lap covering while the weighted end of the towel wraps around the leg or other extremity. The handles are located in one position on the towel and the towel does not have opposing handles.

In one embodiment of the present invention, the towel has hook and loop fasteners proximate to the weights, on the same side of the towel, so that when the towel is wrapped around a limb, the fasteners attach, creating a loop that enhances the drying of the limb. A fastener at a left side near or at the bottom end in conjunction with a fastener on the right side near or at the bottom end conform and hold the towel around the limb to be dried.

For all embodiments, the weights are preferably held in pouches near the end where placed. Preferably said pouches are formed from via rolling over and attaching a towel end to form a pouch structure. Also for the preferred embodiment, a strip of hook and loop fasteners are placed near the open ends of said pouches and allow the weight(s) to be enclosed in the pouch when the fastener is closed and to be removed prior to laundering. Alternative embodiments may utilize a plurality of fastener techniques including but not limited to snaps, buttons, hooks, or latches.

The present invention may be manufactured from a plurality of materials including but not limited to a plurality of moisture absorbent cloths, absorbent polymers, or other flexible materials. The weights are of a dense material such as non-magnetized metallic iron, copper or alloys of metals; lead, preferably pelletized, or sand, and placed within one or more protective weight bags which fit within the pouches. In a preferred embodiment, the protective weight bags are heat resistant up to 140 degrees F. or greater and permanently sewn into the towel, so that the towel can be washed in the laundry and the protective weight bags not damaged. In another embodiment, the dense material can be encased in a hardened polymeric material and placed in the pouches without a protective weight bag.

BRIEF DESCRIPTION OF THE DRAWINGS

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore the drawings are not necessarily to scale. In addition, in the embodiments depicted herein, like reference numerals in the various drawings refer to identical or near identical structural elements.

FIG. 9 is a top view of the resin embedded with pellets weight for use in the towel of the present invention.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
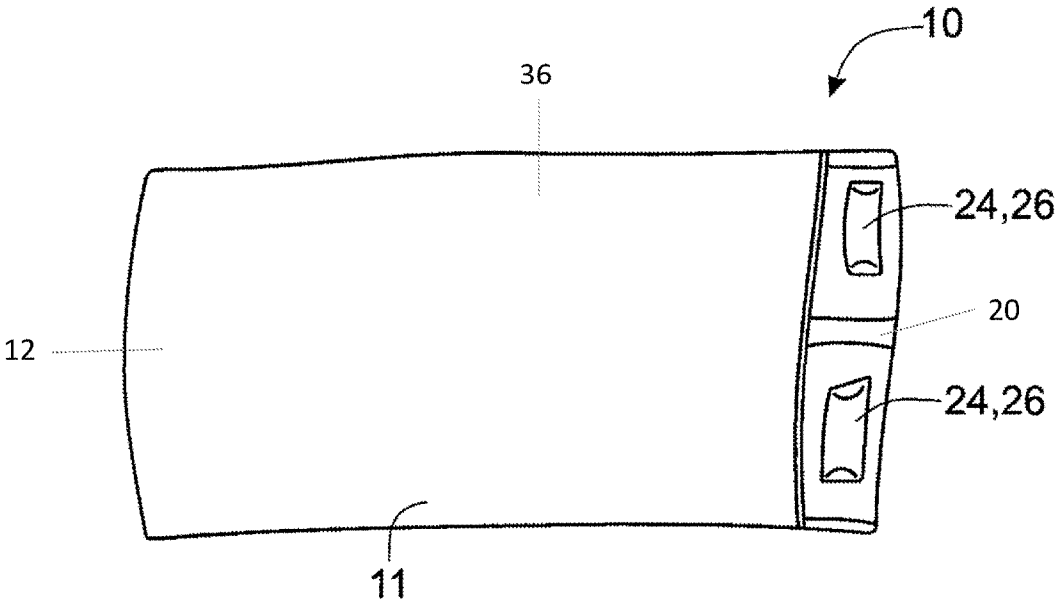
FIG. 1*a* is a front side plan view of an embodiment of the weighted towel of the present invention.
Figure 1B:
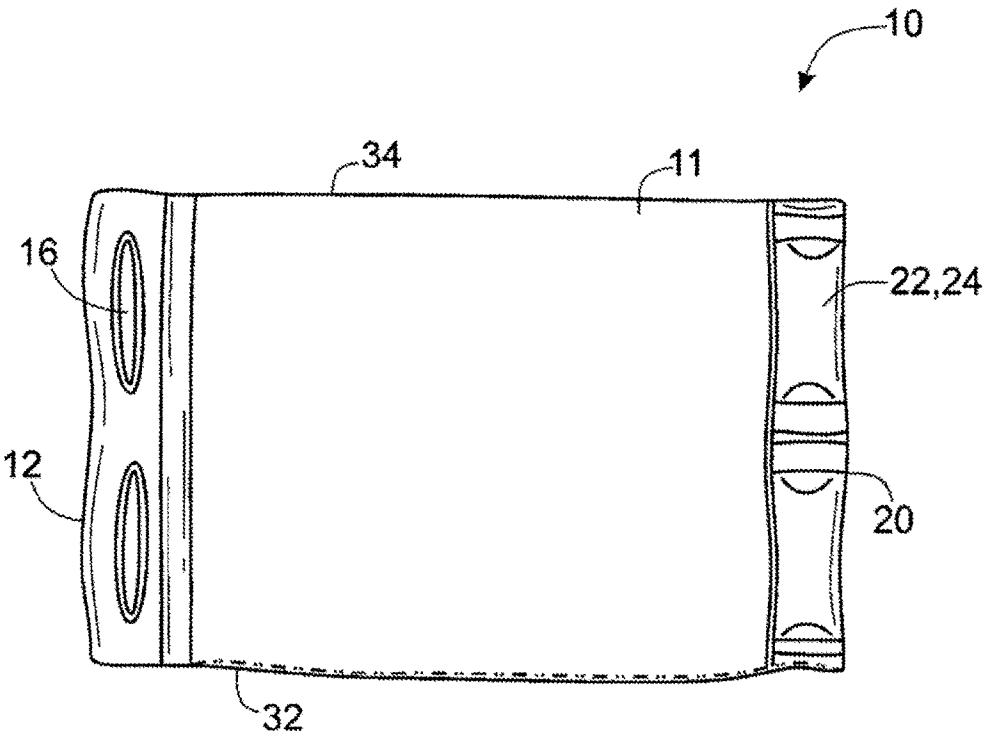
FIG. 1*b* is a front side plan view of an embodiment of the weighted towel with handles showing two slot type handles.
Figure 5A:
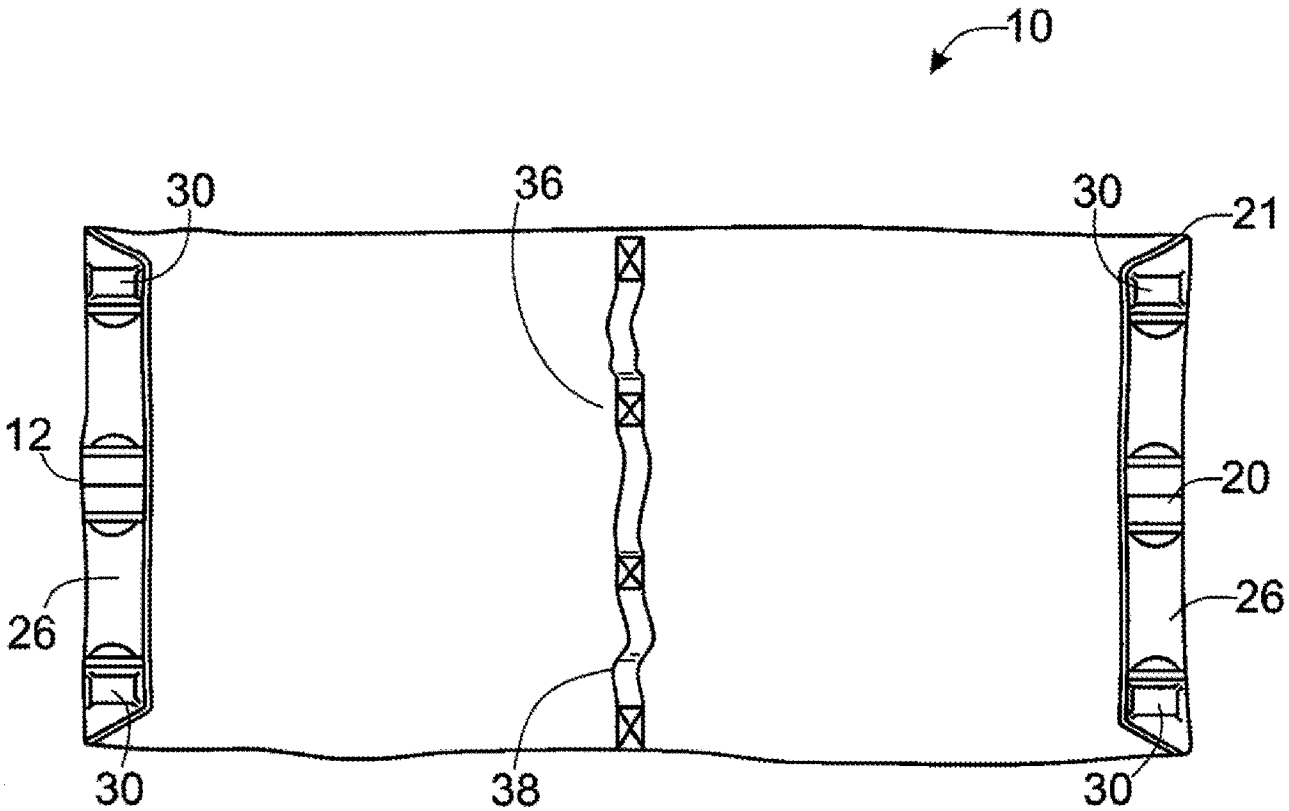
FIG. 5*a* is a third alternative embodiment with handles in the central position and weights at both the top and bottom ends.
Figure 5B:
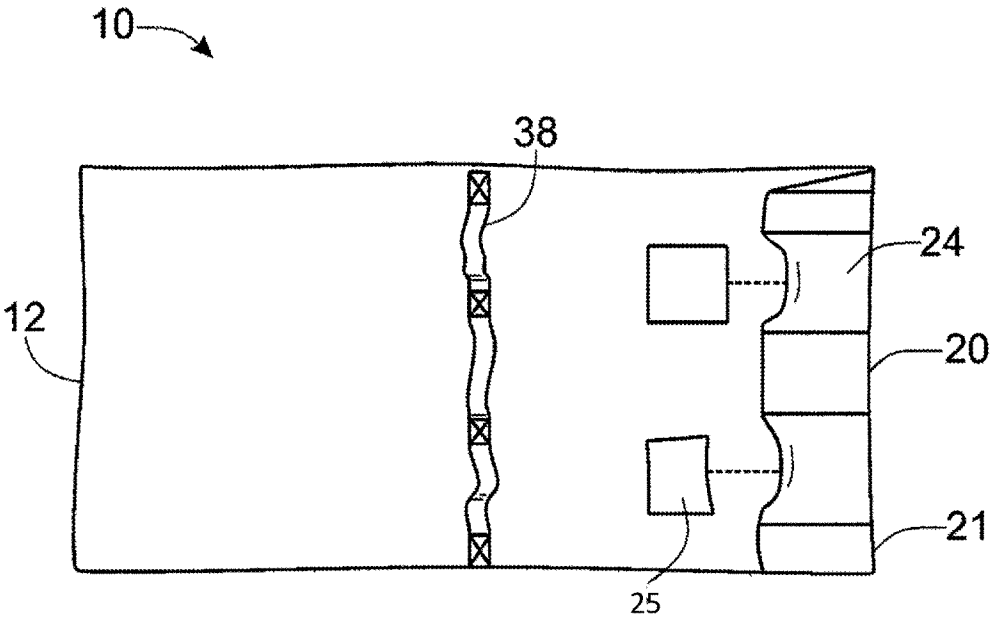
FIG. 5*b* is another embodiment with handles in the central position and weights at the bottom end. The top end is unweighted.
Figure 6:
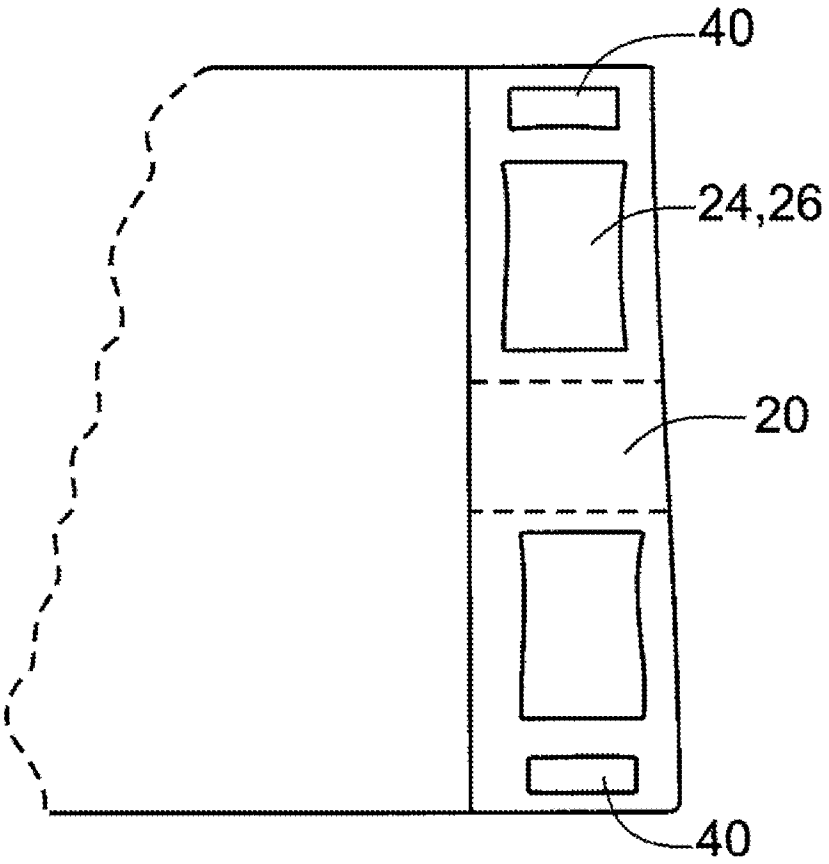
FIG. 6 is an enlarged view of a bottom end embodiment having hook and loop fasteners.

Referring now to the drawings, there is shown in FIG. 1*a*, a preferred embodiment where weighted towel 10 has weights at the bottom end 20, but the center portion 36 and the top end 12 are both un-weighted. In FIGS. 1*b*, 2, 3 and 4 are additional preferred embodiments of the weighted towel 10 with handles 16, 17 and 18. FIGS. 5*a* and 5*b* show a preferred embodiment of the weighted towel with handles 38 in the center portion 36. FIG. 5*a* has weights at the bottom end 20 and the top end 12 with the center portion 36 unweighted. FIG. 5*b* shows weights at the bottom end 20 and an un-weighted top end 12. In FIG. 6 is an enlarged view of the hook and loop corner fasteners 40, which may be utilized with all embodiments. The apparatus 10 allows a user to quickly and easily dry the legs, back, or other body portions even when the user has limited use of one or more hands and arms, or a limited range of motion. The handles are located at one position on the towel and the towel does not have opposing handles to create a drying motion.

For all embodiments, the apparatus 10 is preferably formed into a towel shape from a flexible absorbent material 11. The shape is preferably of a conventional rectangular towel shape but may take a plurality of forms in alternative embodiments including but not limited to square, triangular, or any polygonal form. Also for all embodiments, the apparatus 10 has a top end 12, a bottom end 20, a left side 32, a right side 34, end corners 21 and a central portion 36.

For the preferred embodiment, the apparatus 10 has two slot 16 handles near or at a top end 12 and one or more weights 26 forming a weighted portion 22 near or at a bottom end 20. For the preferred embodiment, the weights 26 are placed within one or more pouches 24 formed at said bottom end 20 by rolling over the towel material 11 and attaching the material 11 together via sewing, adhesives, snaps, hook and loop fasteners or other accepted means of joining fabric. In a preferred embodiment, the weights are permanently sewn onto the towel. Preferably, the weights 26 are formed from a dense non-magnetized material such as non-magnetized stainless steel, iron, copper or metal alloy pellets; lead pellets or sand which is housed or placed in protective weight bags 28 prior to placement within said pouches 24

In a preferred embodiment, the weights 26 are encased in a waterproof, hardened resin polymer material creating an encased weight 60 which is placed in one or more pouches 24. The hardened resin polymer can be an epoxy resin or a hot-melt glue resin, or any of a number of well-known resins that are used to glue the pellets together and encase them in a water-tight covering that can be washed and not damaged. The encased weights, shown in FIG. 9, provide a weight that does not need a protective bag to hold it, and can be laundered in the towel without removal. Preferably, with the encased weight 60, the weight is non-removeably sewn into the pouch 24. The preferred material is stainless steel, zinc or copper coated iron pellets, which are easily encased in the polymeric material.

The preferred weight bags 28 are made from low density polyethylene film which is flexible and resilient, further enhancing the drying effectiveness of the towel. The film is of sufficient thickness to enclose and protect the enclosed material. In a preferred embodiment, the thickness of the film is at least 2 mil. In a more preferred embodiment the thickness of the film is from 2 to 8 mil thick. In a preferred embodiment, the weight bags are made from polymeric material, cloth, such as canvass, or leather. In a more preferred embodiment, the weight bag heat resistant to at least 140 degrees F., and preferably heat resistant to 200 degrees F. or higher. The heat resistance allows the weight bag to be non-removeably sewn into the towel and laundered without damage.

Optionally, the bag 28 is enclosed in a second bag to further strengthen the enclosure. The second bag can be a poly tubing plastic which is sealed on both ends. In a preferred embodiment the thickness of the film of the poly tubing is from 2 to 8 mil thick. The weight bags are strong enough not to tear or rupture if the full weight of the user is placed on the bag, yet flexible enough that when a foot is pressed on it, the bag and pouch conform to the foot and effectively dry between the toes.

Figure 2:
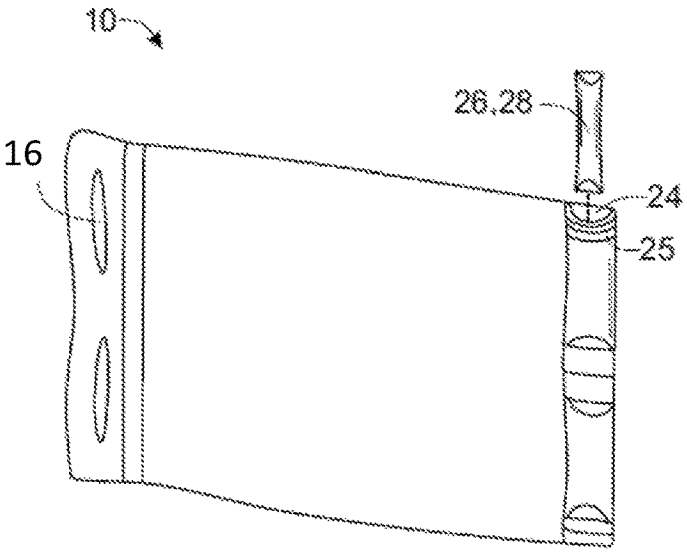
FIG. 2 is a right front perspective view thereof showing a weight removed from a pouch near a bottom end.

Alternative embodiments may utilize solid weights or weights attached directly with the material 11 without the pouches 24. Preferably the pouches 24 may be sewn closed on the end corners 21 and have an opening facing the center portion 36 of the towel, as shown in FIG. 5*b*. Alternatively, each of said pouches 24 may be closed at an end via utilization of a fastener 25 such as hook and loop fasteners in order to retain said weights 26, as shown in FIG. 2. Further alternative embodiments may utilize a plurality of fastener types including but not limited to snaps, hooks, stitches, adhesives, pins, or heat seals.

Figure 10:
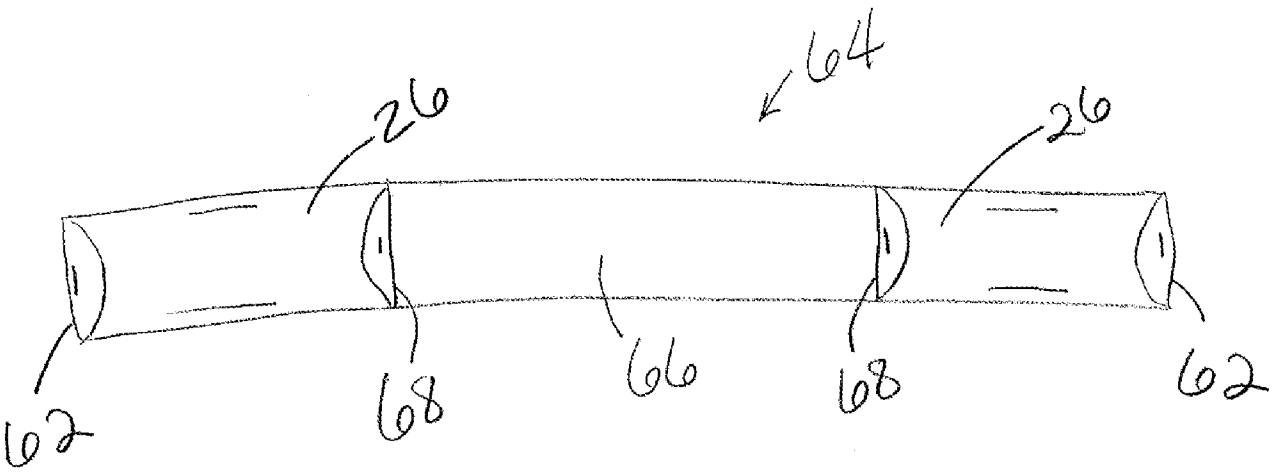
FIG. 10 is a top view of the polytubing containing weights before it is non-removeably sewn into the towel.

In a preferred embodiment, as shown in FIG. 10, the one weight 26 each is inserted into each end 62 of a length of poly tubing 64, with the center portion 66 flat and unweighted. The weighted ends are sealed 68 from the center unfilled portion to prevent shifting of the weights toward the center. Preferably, the poly tubing 64 is non-removeably sewn into the pouches 24 at the end of the towel.

Figure 3:
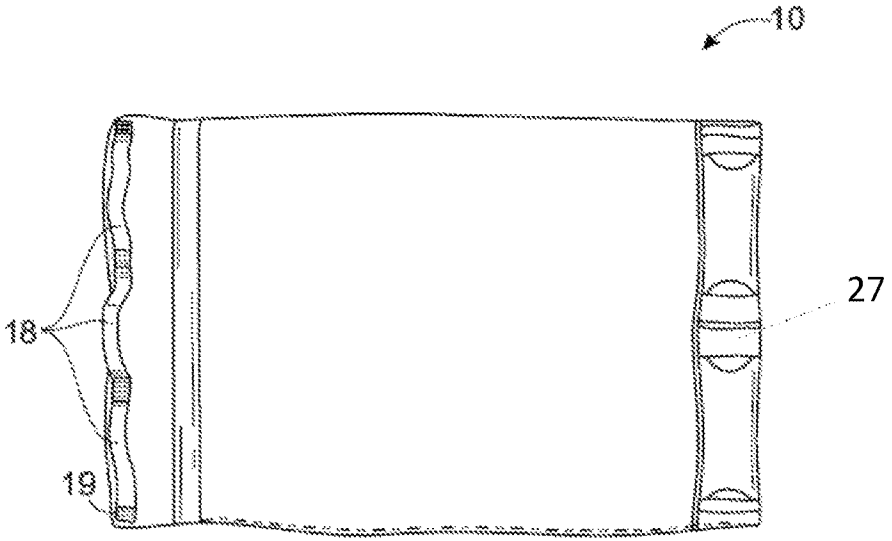
FIG. 3 is a first alternative embodiment of the art of FIG. 1 with a multiple loop type handle.

An embodiment of the present art is presented in FIG. 3 and has all of the elements of the preferred embodiment with the exception that the handles are represented by loop handles 18 located at the top end instead of the slot handles 17 of the preferred embodiment. The loop handles are formed by attaching a strip of material near or at the top end 12 at periodic or one or more positions whereby a gap between said strip and the absorbent material 11 is present at one or more locations. For the embodiment shown in FIG. 3, there are three loop handles 18 and four attachment points 19. Again, the strip attachment may be achieved via a plurality of methods, including but not limited to stitching, adhesives, pins, hook and loop fasteners, or heat sealing.

Figure 4:
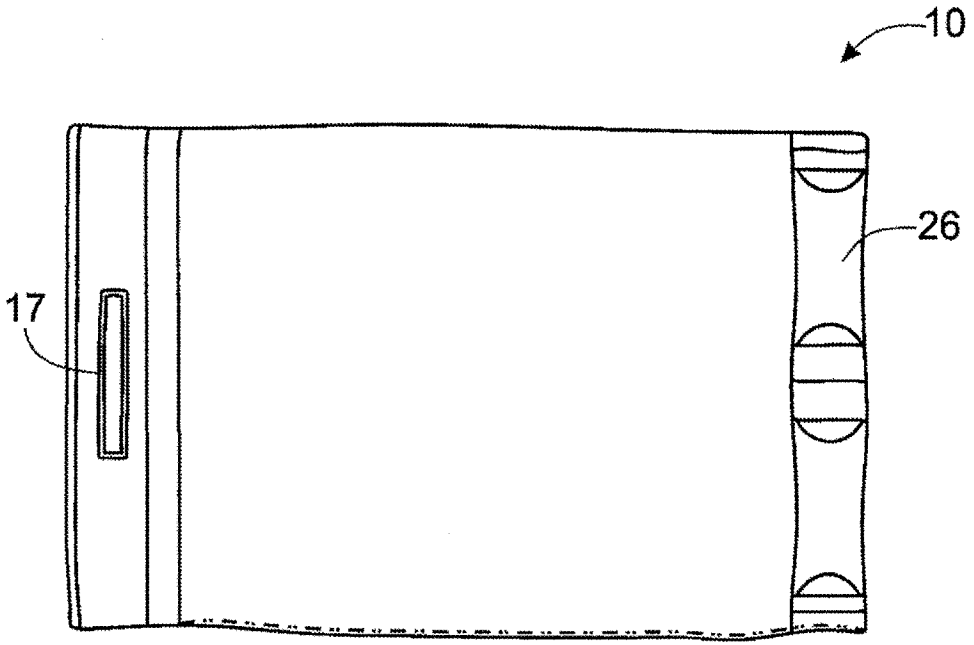
FIG. 4 is a second alternative embodiment with a single handle or grip.

Another embodiment of the present art is presented in FIG. 4 and has all of the elements of the preferred embodiment with the exception that only one slot handle 17 is formed as the handle.

A preferred embodiment is presented in FIG. 5*b*, where weight bags 28 are placed near the bottom end 20 and near the central portion 36 is placed a central handle 38. The pouches 24 are open upward, as the corners are closed by stitching or other appropriate means. The top end 12 and the center portion 36 is un-weighted.

Another embodiment of the present art is presented in FIG. 5*a* and has weights 26 placed near or at both the top end 12 and the bottom end 20. At or near the central portion 36 of the embodiment is placed a central handle 38 which functions as the handles for the apparatus 10.

Figure 7:
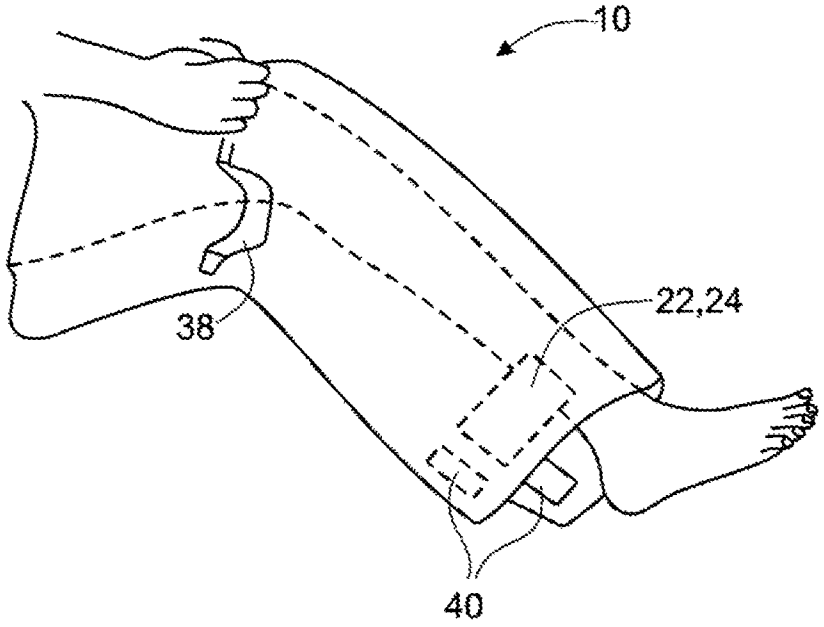
FIG. 7 is a side perspective view of a person using the present invention with hook and loop fasteners to dry his leg.

In operation or use, as shown in FIG. 7, the user holds the apparatus 10 via the handles 38 with one or both hands and places the weighted bottom end 20 onto or over the leg, limb, back, or other body portion to be dried. Gravitational force upon the weights 26 allows the user to easily drape the end 20 at a desired place on the body. The user creates a drying motion by grasping the towel at one point, the center and allowing gravity to pull the towel down, then moving the towel up and down. If the user is utilizing an embodiment having the hook and loop fasteners 40, once placed over the leg or limb, the fasteners 40 will cause the towel to conform and the fasteners to adhere to each other around the leg or limb and allow drying of the area under the leg or limb. When placed, the user moves the apparatus 10 via the handles 16, 17, 18, 38 to complete the drying of the body portion. For other areas of the body, the user repeats the process, all with limited or no assistance from other persons.

Figure 8:
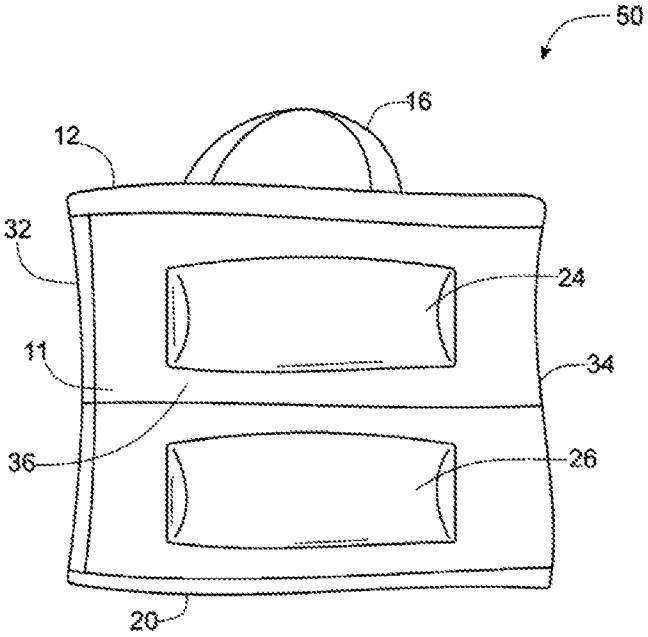
FIG. 8 is a top view of a weighted foot towel.
Figure 5:
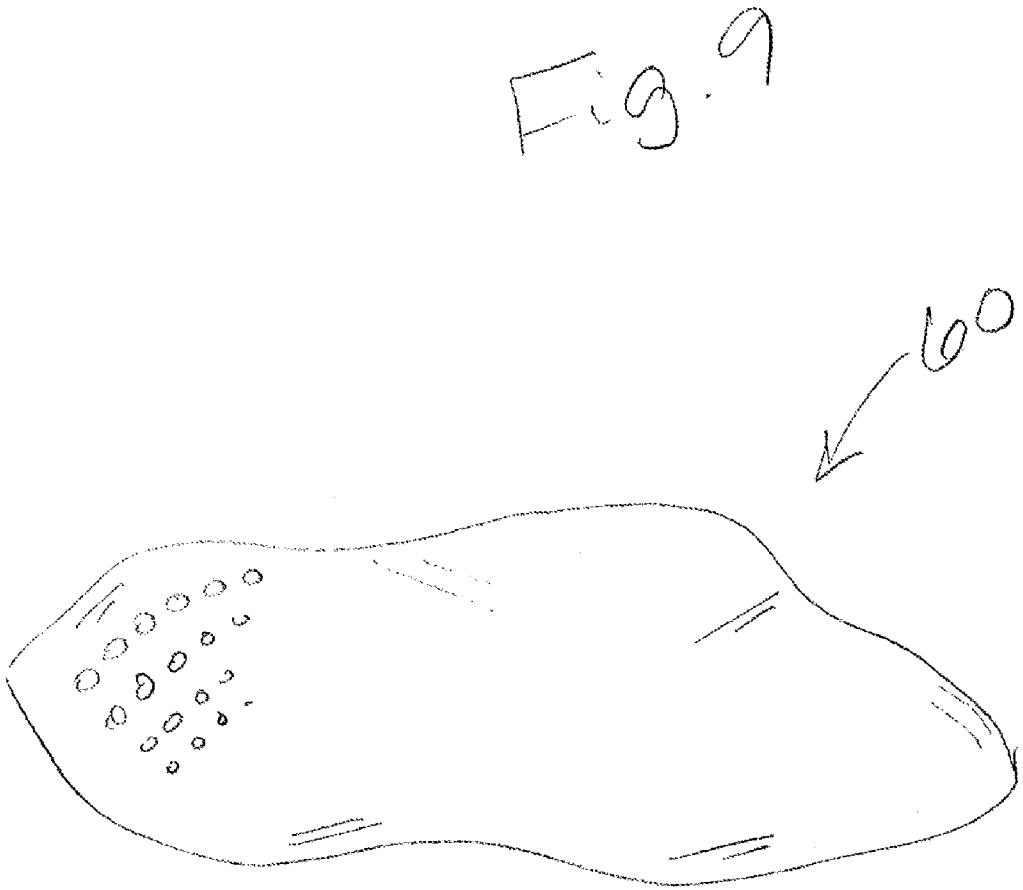

FIG. 8 is a foot towel 50 having a top end 12, a bottom end 20, a right side 34 and a left side 32, and a center 36, wherein located in the center is at least one pocket 24 into which at least one weight 26 is inserted, wherein the at least one weights comprise at least one flexible bag sealingly containing heavy material, and wherein the bags are compressible and resilient to effectively dry a foot and between the toes. Optionally, the foot towel 50 has a handle 16 attached to the top end 12.

The pouches 24 allow easy removal of the weights 26 before laundering and replacement thereof after laundry completion.

Although described for enablement purposes, the lengths, widths, and other dimensional attributes may depart significantly from those specified. The shape, size, location, component numbers and mounting methods utilized for each of the components or constituent elements may take a plurality of forms as recognized within the pertinent arts without departing from the scope and spirit of the present invention.

For a rectangular towel of about 28 inches by 50 inches, the pouches are about 8 inches long by 5 inches deep. For such a towel, the weight bags are about 3 inches by 3 inches. The weight of the bags when filled is sufficient to cause the towel to drape downward when used. Preferably, the weight of the filled bag 28 is from about 4 to 16 ounces. More preferably, the weight of the filled bag is from about 4 to 14 ounces. For the rectangular towel, the pouches 24 are spaced apart, proving a flexible, flat, un-weighted, between-the-weights center portion 27, which is from about 4 to 18 inches wide. More preferably, the between-the-weights center portion 27 is from about 6 to 12 inches wide. In one embodiment the width of the between-the-weights center portion 27 is the same as the width of the pouch 24. This center portion 27 works as a fulcrum about which the weights move to wrap around the body part. It is critical to have the center portion wide enough to allow the weights to wrap around the body part.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A towel for drying a person having an extremity and a lap comprising a rectangle-shaped flexible absorbent material comprising a top end, a bottom end, a left side, a right side and a center portion;

wherein two weights are inserted into pockets positioned at the bottom end;

wherein the weights comprise non-magnetized material;

wherein the top end and the center portion are both un-weighted;

wherein located in the center portion of the towel is at least one loop handle;

wherein the at least one loop handle is located in one position;

wherein there are no opposing handles; and wherein the un-weighted top end acts as a covering for the lap and the weighted bottom end of the towel wraps around the extremity.

2. The towel of claim 1, wherein the non-magnetized material is selected from the group consisting of stainless steel, iron, copper or metal alloy pellets; lead pellets and sand.

3. The towel of claim 2, wherein the non-magnetized material is enclosed in a protective weight bag made of a heat-resistant polymeric material.

4. The towel of claim 3, wherein the heat-resistant polymeric material is heat-resistant up to 140 degrees F. or greater.

5. The towel of claim 4, wherein the encased weight is non-removeably sewn into the pockets.

6. A towel for drying a person having an extremity and a lap comprising a rectangular shaped flexible absorbent material comprising a top end, a bottom end, a left side, a right side and a center portion;

wherein two weights are inserted into pockets positioned at the bottom end;

wherein the weights further comprise non-magnetized material encased in a water-proof resin polymer;

wherein the top end and the center portion are both un-weighted;

wherein located in the center portion of the towel is at least one loop handle;

wherein the at least one loop handle is located in one position;

wherein there are no opposing handles; and wherein the un-weighted top end acts as a covering for the lap and the weighted bottom end of the towel wraps around the extremity.

7. The towel of claim 6, wherein the non-magnetized material is selected from the group consisting of stainless steel, iron, copper or metal alloy pellets, lead pellets and sand.

8. The towel of claim 7, wherein the encased non-magnetized material is not enclosed in a protective bag.

9. The towel of claim 8, wherein the encased non-magnetized material is non-removeably sewn into the pockets.

10. A towel for drying a person having an extremity and a lap comprising a flexible absorbent material comprising a top end, a bottom end, a left side, a right side and a center portion;

wherein two weights are inserted into pockets positioned at the bottom end;

wherein an unweighted between-the-weights center portion is positioned at the bottom end;

wherein the un-weighted between-the-weights center portion is from about 4 to 18 inches wide;

wherein the weights comprise non-magnetized material selected from the group consisting of stainless steel, iron, copper or metal alloy pellets; lead pellets and sand;

wherein the top end and the center portion are both un-weighted;

wherein located in the center portion of the towel is at least one loop handle;

wherein the at least one loop handle is located in one position and there are no opposing handles;

wherein the weights further comprise at least one protective weight bag containing the non-magnetized material; and wherein the un-weighted top end acts as a lap covering and the weighted bottom end of the towel wraps around the extremity.

11. The towel of claim 10, wherein the protective weight bag comprises a heat-resistant polymeric material.

12. The towel of claim 11 wherein the heat-resistant polymeric material is heat-resistant up to at least 140 degrees F.

13. The towel of claim 12, wherein the protective weight bag is non-removeably sewn into the pockets.

14. The towel of claim 10, further comprising a length of poly tubing having two ends and an unweighted between-the-weights center portion; and wherein the weights are inserted and sealed one into each end.

15. The towel of claim 14, wherein the wherein the weighted ends are sealed from the center between-the-weights unweighted portion.

16. The towel of claim 14, wherein the poly tubing is non-removeably sewn into the pouches at the end of the towel.

* * * * *